United States Patent [19]

Smith

[11] Patent Number: 4,534,249

[45] Date of Patent: Aug. 13, 1985

[54] STROKE CONTROL FOR PRESS

[75] Inventor: Richard J. Smith, Bristol, England

[73] Assignee: USM Corporation, Farmington, Conn.

[21] Appl. No.: 384,546

[22] Filed: Jun. 3, 1982

[30] Foreign Application Priority Data

Jun. 6, 1981 [GB] United Kingdom ..... 8117390

[51] Int. Cl.[3] ..... B26D 5/00

[52] U.S. Cl. ..... 83/74; 83/525; 83/530; 100/258 R

[58] Field of Search ..... 83/13, 62, 62.1, 72, 83/74, 525, 531–541, 637, 527, 529, 530; 100/46, 258 R, 258 A, 48; 72/21

[56] References Cited

U.S. PATENT DOCUMENTS

| | | | |
|---|---|---|---|
| 2,821,670 | 1/1958 | Bradley | 83/525 |
| 3,046,874 | 7/1962 | Dehn | 83/525 |
| 3,153,965 | 10/1964 | Muhlbach | 83/525 |
| 4,154,130 | 5/1979 | Smith et al. | 83/525 |
| 4,157,066 | 6/1979 | Pretty | 100/46 |
| 4,356,763 | 11/1982 | Hagstrom | 100/48 |

FOREIGN PATENT DOCUMENTS

| | | | |
|---|---|---|---|
| 431036 | 8/1975 | U.S.S.R. | 100/258 A |

*Primary Examiner*—James M. Meister
*Assistant Examiner*—John L. Knoble
*Attorney, Agent, or Firm*—Alan N. McCartney

[57] ABSTRACT

A method and apparatus for controlling the stroke of a press in which the movements of two portions of a movable platen of the press are continuously sensed during a stroke. A signal is generated whose magnitude at any time during a stroke is dependent on the sum of the distances moved by the two portions of the movable platen during the stroke. The signal is compared with a preselected value which is selected in accordance with the length of the stroke required and the stroke is terminated when the magnitude of the signal equals the preselected value.

6 Claims, 4 Drawing Figures

STROKE CONTROL FOR PRESS

BACKGROUND OF THE INVENTION

This invention is concerned with stroke control for a press and in particular with methods of and apparatus for controlling the stroke of a press which comprises a stationary platen, a movable platen, and a plurality of columns on which the movable platen is mounted and which move to move the movable platen towards the stationary platen in a stroke of the press.

In the operation of many presses, a workpiece is placed on the stationary platen of the press and a stroke of the press takes place to bring the movable platen into pressing engagement with the workpiece. In such presses, it is necessary to terminate the stroke of the press once the workpiece has been pressed sufficiently and before damage occurs to the press. To cause the stroke to be terminated at the correct time, presses are provided with stroke control apparatus which senses the position of a portion of the movable platen and causes the stroke to be terminated when that portion reaches a preselected point. The stroke control apparatus is set for a particular type of workpiece and then in many cases operates many times without further setting. Consistent results can be achieved provided that the workpiece is always located in the same position on the stationary platen but this may not be possible or desirable. For example, where a sheet material is spread on the stationary platen and is press-cut by having a shaped knife pressed through it, the knife is generally moved along the stationary platen between strokes of the press. Furthermore, positioning of workpieces continually at the same position causes the platens to become worn more rapidly than if the workpieces are positioned at different positions.

Once the stroke control apparatus of a press has been set with the workpiece in a particular position, its accuracy will be reduced if the workpiece is positioned elsewhere. Generally, if the workpiece is positioned near an edge of the stationary platen, once the movable platen contacts the workpiece there is a tendency for the movable platen to tilt thereby affecting the accuracy of the stroke control apparatus. Since stroke control apparatuses sense the position of an edge portion of the movable platen and are generally set with a workpiece in the center of the stationary platen, if the workpiece is near the portion sensed, the stroke control apparatus may react later than is desirable whereas, if the workpiece is remote from the portion sensed, the stroke control apparatus may react sooner than is desirable. Although many presses have balancing mechanisms that alleviate this problem by endeavouring to maintain the two platens parallel to one another, they do not react sufficiently rapidly to overcome the problem. The problem could be reduced by sensing the movement of a central portion of the movable platen but to position stroke control apparatus in such a position is highly inconvenient.

SUMMARY OF THE INVENTION

It is an object of the present invention to provide a method of controlling the stroke of a press in which the effects of the problem described above are reduced.

The invention provides a method of controlling the stroke of a press which comprises a stationary platen, a movable platen, and a plurality of columns on which the movable platen is mounted and which move to move the movable platen towards the stationary platen in a stroke of the press, the method comprising continuously sensing the movements of two portions of the movable platen during a stroke, which portions are symmetrically located with respect to the columns, generating a signal the magnitude of which at any time during a stroke is dependent on the sum of the distances moved by the two portions during the stroke, comparing the signal with a preselected value, which value is selected in accordance with the length of stroke desired, and terminating the stroke when the magnitude of the signal equals the preselected value.

Preferably, to enable the stroke control apparatus to be conveniently positioned, for example beneath the movable platen, the two portions of the movable platen whose movements are sensed are portions thereof to which columns of the press are attached and their movements are sensing the movement of the columns.

For increased accuracy in controlling the stroke of a four-column press in which the columns are arranged at the corners of a rectangle, the movements of two diagonally-opposed columns are sensed.

The invention also provides a stroke control apparatus suitable for use in a method as described in the last preceding paragraph but also comprising a variable impedance device having two relatively movable portions and the output of which is dependent on the relative positions of the two relatively movable portions thereof, mechanical connections connecting each of the two portions of the movable platen to one of the relatively movable portions of the variable impedance device so that movement of each of the two portions of the movable platen causes movement of one of the relatively movable portions of the variable impedance device, comparing means operable to compare the output of the variable impedance device with a preselected value, and terminating means operable to terminate a stroke of the press when the magnitude of the output of the variable impedance device equals the preselected value.

Where the press has a balancing valve operable to maintain the two platens parallel to one another, the mechanical connections can be utilized in two ways if they are also connected to a spool of the balancing valve in such a way that the spool is moved if one of the portions of the movable platen moves more than the other and the valve acts to balance the movements.

The invention also provides a stroke control apparatus suitable for use in a method as described in the last preceding paragraph but also comprising two variable impedance devices, one associated with each of the two portions of the movable platen and each having a movable portion whose position determines the output of the device, the movable portion of each device being mechanically connected to its associated portion of the movable platen so that movement of the portion causes movement of the movable portion, averaging means operable to average the outputs of the two variable impedance devices, comparing means operable to compare the average of the outputs of the two variable impedance devices with a preselected value, and terminating means operable to terminate a stroke of the press when the magnitude of the average of the outputs of the two devices equals the preselected value.

There now follows a detailed description, to be read with reference to the accompanying drawings, of two apparatuses and their methods of operation which are illustrative of the invention. It is to be understood that the illustrative apparatuses and methods have been selected for description by way of example and not of limitation of the invention.

DESCRIPTION OF THE PREFERRED EMBODIMENT

Figure 1:
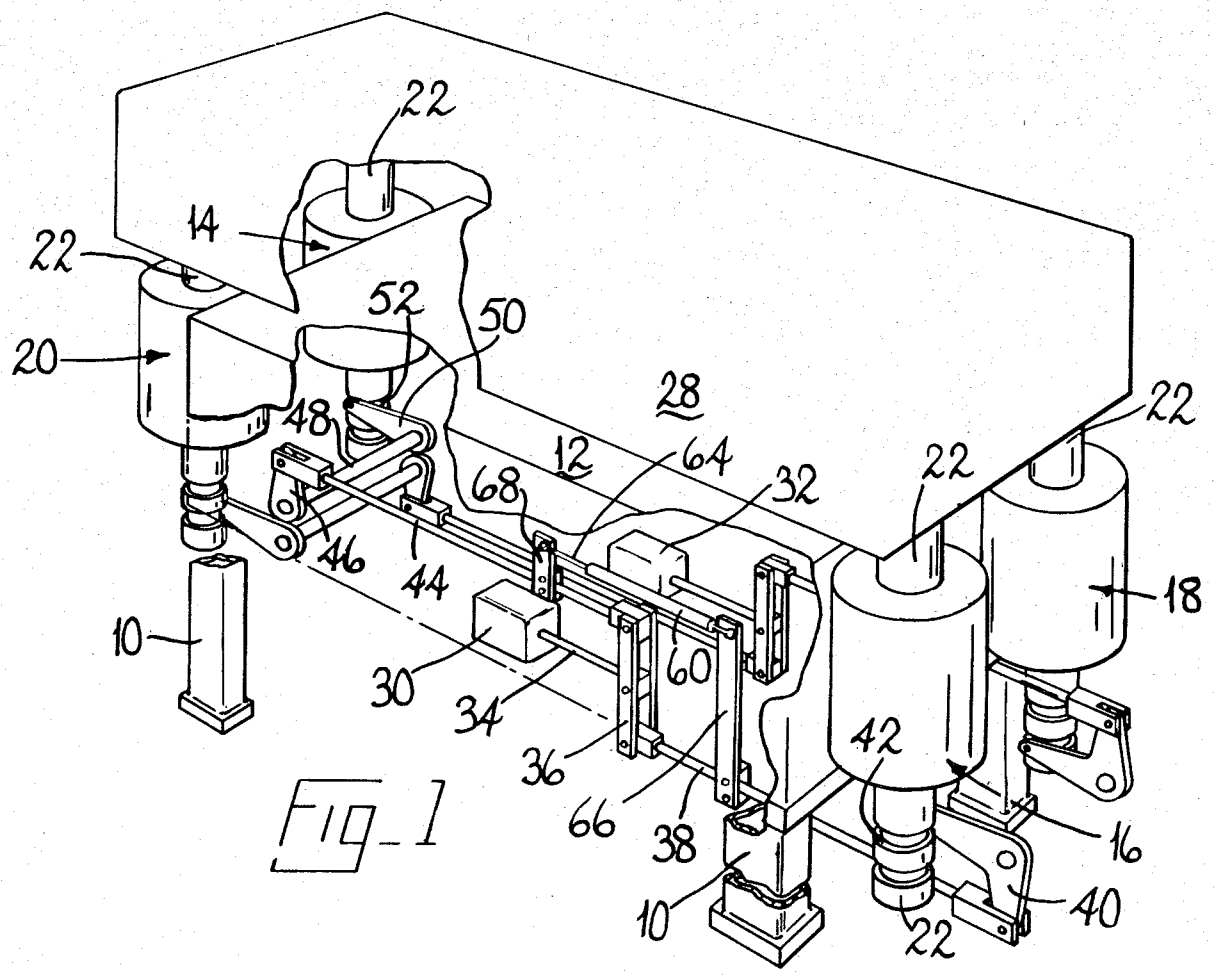
FIG. 1 is a perspective view, with parts broken away, of the first illustrative press which is a four-column press.

The first illustrative press shown in FIG. 1 comprises a framework 10 on which is mounted a stationary lower platen 12. The lower platen 12 is substantially rectangular in plan view and, at corner portions of this rectangle, four piston and cylinder assemblies 14, 16, 18 and 20 are mounted on the framework 10. The assemblies 14 and 16 and the assemblies 18 and 20 respectively are diagonally-opposed to one another. The piston (not shown) of each of the assemblies 14, 16, 18 and 20 is attached to a piston rod 22 which projects upwardly and downwardly of the assembly so that operation of the assembly causes vertical longitudinal movement of the piston rod 22.

The four piston rods 22 are all attached at an upper end portion thereof to a corner portion of a movable upper platen 28 of the press so that operation of the four assemblies 14, 16, 18 and 20 to move the piston rods 22 downwards moves the upper platen 28 downward towards the lower platen 12 in an operative stroke of the press, and operation of the four assemblies 14, 16, 18 and 20 to move the piston rods 22 upwards moves the upper platen 28 upwards away from the lower platen 12 in a return stroke of the press. The four piston rods 22 thus form columns of the press on which the movable platen 28 is mounted and which move to move the movable platen 28 towards the stationary platen 12 in a stroke of the press.

Figure 2:
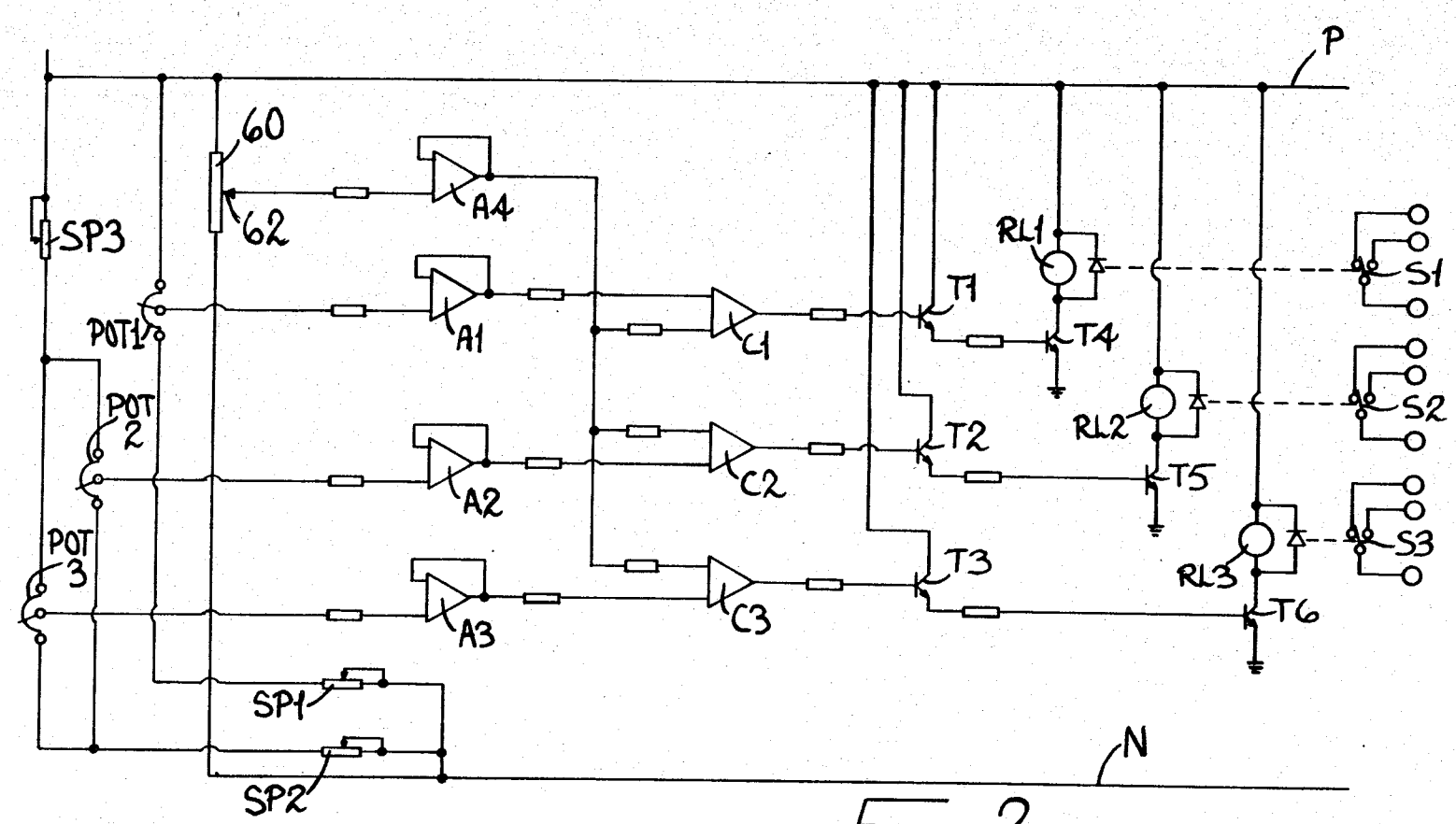
FIG. 2 is a diagrammatic view of electrical circuitry of the first illustrative press.

The four piston and cylinder assemblies 14, 16, 18 and 20 are connected together in the same hydraulic circuit (not shown) which is controlled by solenoid valves which are in turn controlled by electrical switches S1, S2 and S3 (visible in FIG. 2). The arrangement is such that, when the switch S1 is operated a return stroke of the press is terminated and the press comes to rest in an open condition. Operator-actuated switches (not shown) are also provided for initiating an operative stroke of the press and also for selecting which of the switches S2 or S3 is to be rendered effective to terminate the operative stroke. When either the switch S2 or the switch S3 is operated, an operative stroke of the press terminates and a return stroke begins. Operator-operated switches (not shown) are also provided which cause the press to commence an operative stroke. Which of the switches S2 and S3 is effective to terminate a stroke is selected by which operator-operated switches are used. Upon operation of the selected one of S2 or S3, a solenoid valve (not shown) is operated to reverse the stroke of the hydraulic cylinders and thus to initiate the return stroke of the press. The use of solenoid valves in cutting presses is well known in the art as illustrated by U.S. Pat. Nos. 3,153,965 and 4,157,066.

The hydraulic circuit of the first illustrative press also comprises two balancing valves 30 and 32 (FIG. 1). The valve 30 is associated with the first and second assemblies 14 and 16 and is operable, in response to either of these assemblies becoming advanced in its movement relative to the other of those assemblies, to throttle the exhaust of hydraulic fluid from the advanced assembly so that the press is brought back into balance. The valve 30 throttles an exhaust when a spool 34 thereof is moved into or out of the valve 30. If the spool 34 is moved into the valve 30, the exhaust from the assembly 14 is throttled while, if the spool 34 is moved out of the valve 30, the exhaust from the assembly 16 is throttled. Thus, the valve 30 acts to maintain the upper platen 28 horizontal along a diagonal line between the assemblies 14 and 16. The valve 32 acts in the same way with regard to the assemblies 18 and 20. The balancing valves 30 and 32 are thus operable to maintain the two platens 12 and 28 parallel to one another.

The valve 30 is mounted on the frame work 10 at a front central portion thereof while the valve 32 is mounted on a rear central portion of the framework 10. The spool 34 of the valve 30 is pivotally connected to a central portion of a lever 36. A lower end portion of the lever 36 is pivotally connected to a link 38 which is in turn pivotally connected to one arm of a bell-crank lever 40 which is pivotally mounted on the framework 10 adjacent the assembly 16. The other arm of the bell-crank lever 40 carries a cam (not shown) which is received in a groove 42 in the piston rod 22. Movement of the piston rod 22 causes the bell-crank lever 40 to pivot moving the link 38 and thus the lower end portion of the lever 36. An upper end portion of the lever 36 is pivotally connected to a link 44 which is in turn pivotally connected to a lever 46 which is fixed on a shaft 48. The shaft 48 is pivotally mounted on the frame work 10 and carries a lever 50 which is fixed on the shaft 48 and carries a cam (not shown) which is received in a groove 52 in the piston rod 22 of the assembly 14. Movement of the piston rod 22 of the assembly 14 causes the shaft 48 to pivot moving the link 44 and thus the upper end portion of the lever 36. Thus, during an operative stroke of the press, the links 38 and 44 are moved in opposite directions and, so long as the links 38 and 44 move an equal amount, the center of the lever 36 does not move and nor does the spool 34. However, if one of the links 38 and 44 moves more than the other the spool 34 will be moved to correct the imbalance. As shown in FIG. 1, a similar arrangement of levers and links is associated with the valve 32 and the assemblies 18 and 20. Thus, each diagonally-opposed pair of assemblies has its own balancing means.

A variable impedance device of the first illustrative press is associated with the balancing means of the assemblies 14 and 16. The device is in the form of a linear potentiometer having a horizontally-extending coil 60 and a moving contact 62 (FIG. 2) attached to a rod 64 which extends into the coil 60. The coil 60 and the contact 62 form two relatively movable portions of the potentiometer and the output of the potentiometer is dependent on the relative positions of these two relatively movable portions. The coil 60 is attached to a vertically-extending bar 66 which is clamped to the link 38 so that movement of the link 38 caused by movement of the piston rod 22 of the assembly 16 causes horizontal movement of the coil 60. The rod 64 is attached to a vertically-extending bar 68 which is clamped to the link 44 so that movement of the link 44 caused by movement of the piston rod 22 of the assembly 14 causes horizontal movement of the moving contact 62. The links 38 and 44, the bell crank lever 40, the levers 46 and 50 and the shaft 48 thus form mechanical connections, which through the piston rods 22, connect each of two portions of the movable platen 28 (those portions to which the piston rods 22 of the assemblies 14 and 16 are attached, those portions being symmetrically located with respect to the columns of the press) to one of the relatively movable portions 60 and 62 of the potentiometer. The arrangement is such that movement of each of the two portions of the movable platen 28 causes movement of one of the relative movable portions 60 and 62. Thus, the voltage on the moving contact 62 is dependent on the position of both the coil 60 and the contact 62 and is hence dependent on the sum of the movements of the piston rods 22 of the assemblies 14 and 16. Since the piston rods 22 are directly attached to the upper platen 28, the voltage on the moving contact 62 is dependent on the average separation of the platens 12 and 28 along the line between the assemblies 14 and 16, and this average separation is equal to the separation half way between the assemblies 14 and 16. The voltage on the moving contact 62 thus indicates the separation of the platens 12 and 28 at the center of the operative area of the press.

The potentiometer 60, 62 forms part of the electrical circuit shown in FIG. 2. This circuit receives a d.c. power input on a positive line P and a negative line N. The coil 60 of the potentiometer 60, 62 is connected between the lines P and N. The circuit also comprises three operator-settable potentiometers POT 1, POT 2, and POT 3, each of which has its moving contact connected to a voltage stabilizer in the form of an amplifier with a feedback loop (A1, A2 and A3 respectively) which acts to prevent undesired fluctuations in the voltage received from the moving contact 62. The potentiometer POT 1 has its coil connected in series with a setting potentiometer SP 1 between the lines P and N. The potentiometers POT 2 and POT 3 are connected in parallel, in series with two setting potentiometers SP2 and SP3, between the lines P and N. The purpose of the setting potentiometers SP1, SP2, and SP3 is to allow tuning so that the full range of the potentiometers POT 1, POT 2 and POT 3 can be utilized. The moving contact 62 is connected to a voltage stabilizer in the form of an amplifier A4 with a feedback loop.

The outputs of the amplifiers A1 and A4 are connected to a comparator C1 which produces an output in the form of a positive voltage so long as the input it receives from the amplifier A4 is greater than that which it receives from the amplifier A1 but, when this is not the case, the comparator C1 produces no output. The output of the comparator C1 is connected to the base of the transistor T1 which has its collector connected to the line P and its emitter connected to the base of a transistor T4. The transistor T4 has its emitter earthed and a relay RL1 is connected between the line P and the collector of the transistor T4. The relay RL1 operates the switch S1. The arrangement is such that, as the upper platen 28 of the first illustrative press is raised in a return stroke of the press, the voltage on the moving contact 62 becomes increasingly negative until it is no longer greater than the voltage from the potentiometer POT 1. When this occurs, the comparator C1 switches off its output thereby switching off the transistor T1 which in turn switches off the transistor T4 thereby de-energizing the relay RL1 so that the switch S1 is operated to terminate the return stroke.

The potentiometers POT 2 and POT 3 are both arranged to terminate operative strokes of the press and the settings thereof allow two alternative stroke terminating positions. Which of the potentiometers POT 2 and POT 3 is effective to terminate a particular operative stroke is determined by electrical connections (not shown) to the switches S2 and S3. Since the functions of and connections to the potentiometers POT 2 and POT 3 are identical only those relating to the potentiometer POT 2 will be described, with reference numbers relating to the potentiometer POT 3 being given in brackets after those relating to the potentiometer POT 2.

As described above the potentiometer POT 2 (POT 3) has its moving contact connected to the amplifier A2 (A3). The outputs of the amplifiers A2 (A3) and A4 are connected to a comparator C2 (C3) which produces an output in the form of a positive voltage so long as the input it receives from the amplifier A2 (A3) is greater than that which it receives from the amplifier A4 but, when this is not the case, the comparator C2 (C3) produces no output. The output of the comparator C2 (C3) is connected to the base of a transistor T2 (T3) which has its collector connected to the line P and its emitter connected to the base of a transistor T5 (T6). The transistor T5 (T6) has its emitter earthed and a relay RL2 (RL3) is connected between the line P and the collector of the transistor T5 (T6). The relay RL2 (RL3) operates the switch S2 (S3). The arrangement is such that, as the upper platen 28 is lowered in an operative stroke, the voltage on the moving contact 62 increases until it equals that on the moving contact of the potentiometer POT 2 (POT 3). When this occurs, the comparator C2 (C3) switches off its output thereby switching off the transistor T2 (T3) which in turn switches off the transistor T5 (T6) thereby de-energizing the relay RL2 (RL3) so that the switch S2 (S3) is operated to terminate the operative stroke.

The electrical circuit shown in FIG. 2 comprises comparing means in the form of the comparator C2 operable to compare the output of the potentiometer 60, 62 with a preselected value selected by the setting of the potentiometer 60, 62 and terminating means T in the form of the relay RL2 operable to terminate a stroke of the press when the magnitude of the output equals the preselected value. The circuit also comprises alternative comparing means in the form of the comparator C3 operable to compare the output of the potentiometer 60, 62 with an alternative preselected value selected by the setting of the potentiometer POT 3, and alternative terminating means in the form of the relay RL3 operable to terminate a stroke of the press when the magnitude of the output is equal to the alternative preselected value. The circuit also comprises further comparing means in the form of the comparator C1 operable to compare the magnitude of the output of the potentiometer 60, 62 with a further preselected value selected by the setting of the potentiometer POT 1 in accordance with the length of return stroke of the movable platen 28 away from the stationary platen 12. The circuit also comprises further terminating means in the form of the relay RL1 which is operable to terminate a return stroke when the magnitude of the output is equal to the further preselected value.

In the operation of the first illustrative press, the movements of the two portions of the movable platen 28 which are attached to the piston rods 22 of the assemblies 14 and 16 are continuously sensed during a stroke by means of the mechanical connections 38, 40, 44, 46, 48 and 50 by sensing the movement of the piston rods 22 forming the columns. The potentiometer 60, 62 generates a signal in the form of a voltage the magnitude of which at any time during a stroke is dependent on the sum of the distances moved by the two portions during the stroke. The comparator C2 or alternatively C3 compares the signal with a preselected value from the potentiometer POT 2 or POT 3 and the stroke is terminated by the relay RL2 or RL3 when the magnitude of the signal equals the preselected value.

Figure 3:
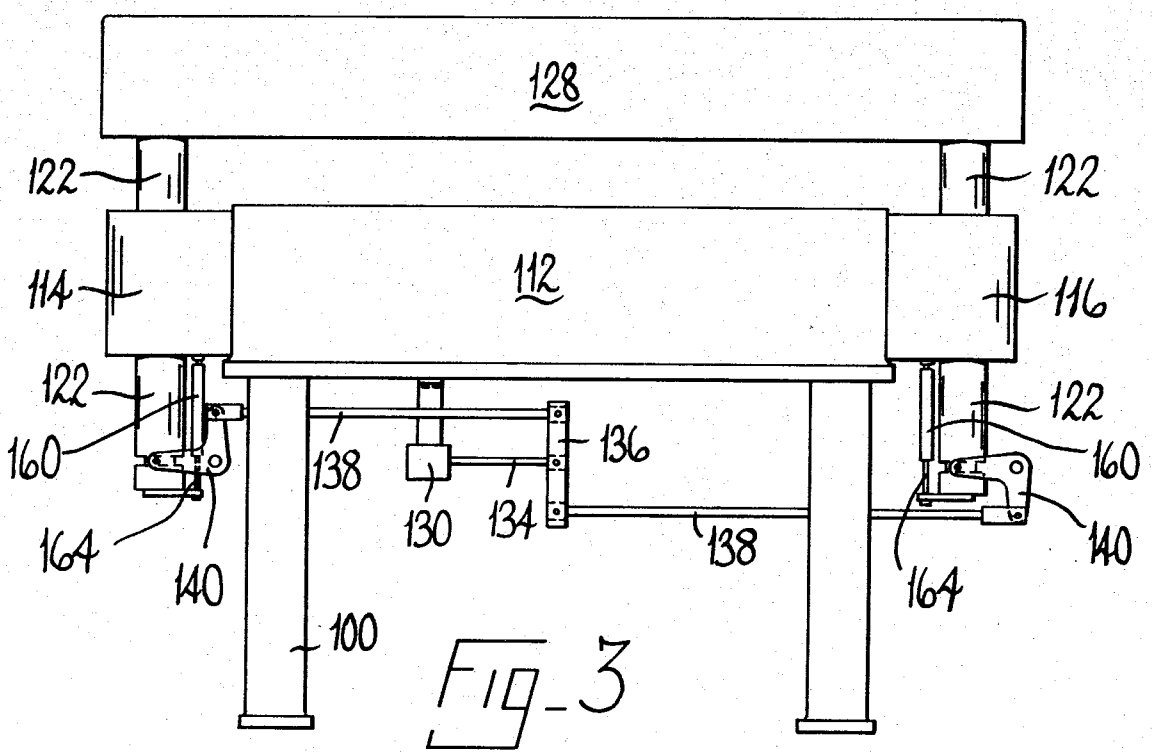
FIG. 3 is a front elevational view of the second illustrative press which is a two-column press.

The second illustrative press shown in FIG. 3 comprises a framework 100 on which is mounted a stationary lower platen 112 which has a piston and cylinder assembly 114 and 116 mounted at each end thereof. The pistons (not shown) of the assemblies 114 and 116 are each attached to a piston rod 122 of the assembly which projects upwardly and downwardly of the assembly so that operation of the assembly causes vertical longitudinal movement of the piston rod 122.

The two piston rods 122 are both attached at an upper end thereof to an upper platen 128 of the press which is supported between the two piston rods 122. The two piston rods 122 form columns on which the movable platen 128 is mounted and which move to move the movable platen toward the stationary platen 112 in a stroke of the press. Operation of the two assemblies 114 and 116 to move the piston rod 122 downwards moves the upper platen 128 downwards towards the lower platen 112 in an operative stroke of the press, and operation of the assemblies 114 and 116 in the opposite direction moves the upper platen 128 upwards in a return stroke of the press.

The assemblies 114 and 116 are connected together in the same hydraulic circuit (not shown) which is controlled (in like manner to that of the first illustrative press) by solenoid valves controlled by electrical switches S1, S2 and S3. The electrical circuit of the second illustrative press is shown in FIG. 4 and is identical in construction and operation to that of the first illustrative press except for differences described below.

The hydraulic circuit of the second illustrative press also comprises a balancing valve 130 which operates in identical manner to the valves 30 and 32 of the first illustrative press. Associated with the valve 130 is a spool 134, a lever 136, two links 138 and two bell-crank levers 140 which are pivoted by the movement of the piston rods 122 and act to move the links 138 so that unequal movement of the piston rods 122 causes movement of the spool 134 to throttle the exhaust from whichever assembly 114 or 116 has become advanced relative to the other.

Associated with each of the assemblies 114 and 116 is a variable impedance device in the form of a potentiometer having a vertically-extending coil 160 and a moving contact 162 (FIG. 4) attached to a rod 164 which extends into the coil 160. Each coil 160 is mounted so that it depends from the cylinder of one of the assemblies 114 and 116 and the rod 164 of each potentiometer is attached to a lower end portion of the piston rod 122 of the assembly so that movement of the piston rod 122 causes the rod 164 to move vertically and hence the moving contact 162 to move within the coil 160. The second illustrative press thus comprises two variable impedance devices, one associated with each of the two portions of the movable platen 128 to which the piston rods 122 are attached. Each device has a movable portion in the form of the contact 162 whose position determines the output of the device. The contacts 162 are mechanically connected through the piston rods 122 to the associated portion of the movable platen 128 so that movement of the portion of the movable platen causes movement of the contact 162.

Figure 4:
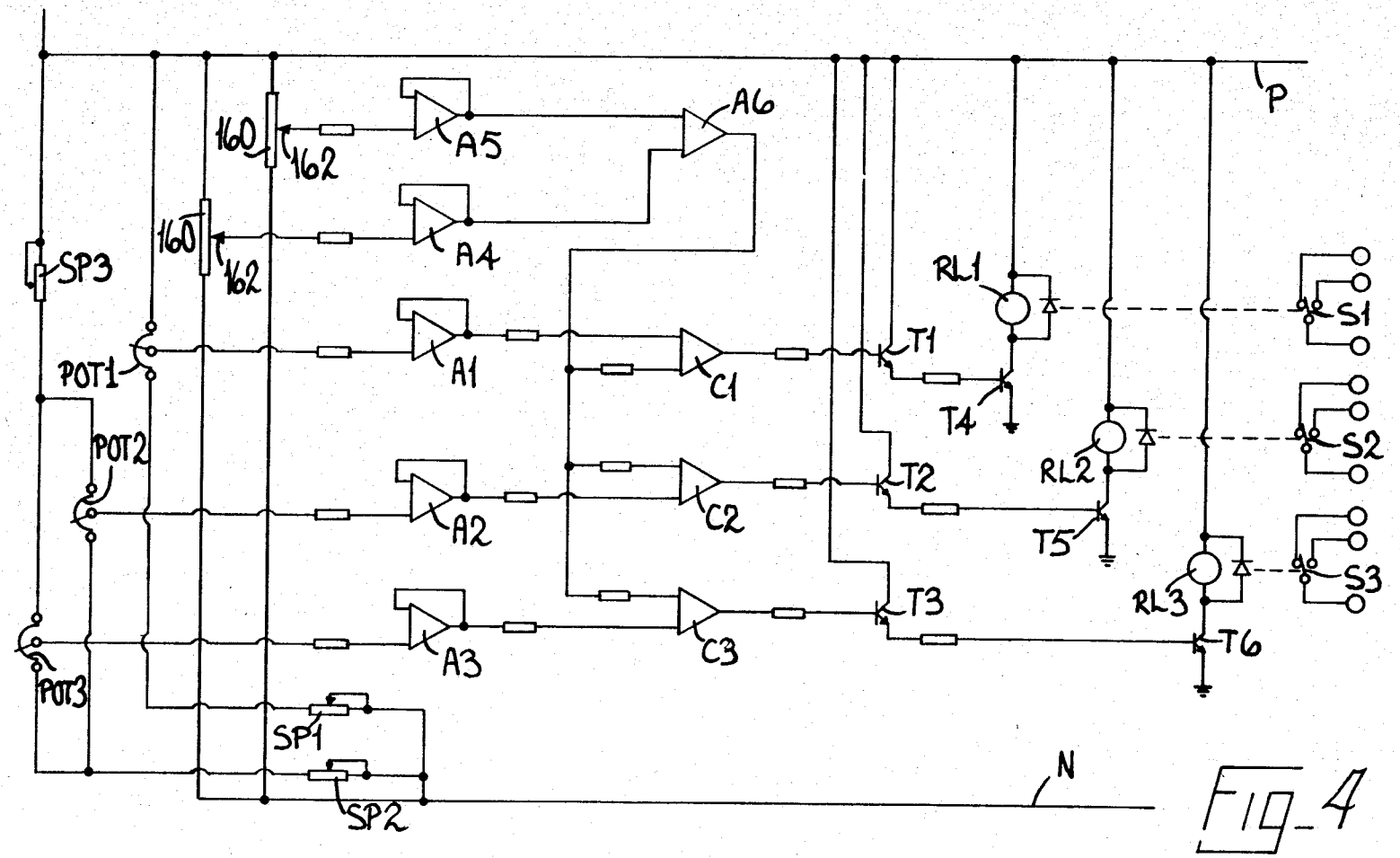
FIG. 4 is a diagrammatic view of electrical circuitry of the second illustrative press.

The potentiometers 160, 162 form part of the electrical circuit shown in FIG. 4. This circuit is identical to that shown in FIG. 2 except that, instead of one potentiometer with an associated amplifier A4, the circuit contains the two potentiometers 160, 162 connected in parallel and amplifiers A4 and A5 are associated one with each potentiometer. The two amplifiers A4 and A5 have their outputs connected to an amplifier A6 which acts as averaging means operable to average the outputs of the two potentiometers 160, 162 and produce an output equal to the average of the inputs it receives from the amplifiers A4 and A5 and supplies this output to the comparator C1.

The operation of the second illustrative press is identical to that of the first illustrative press described above except that where the first illustrative press uses the output of the potentiometer 60, 62, the second illustrative press uses the average of the outputs of the two potentiometers 160, 162.

It will be apparent that, in both the first and the second illustrative press, the accuracy of the stroke control apparatus is enhanced because the control depends on the sum of the movements of two portions of the movable platen. Furthermore, because the movement of columns is sensed, the stroke control apparatus can be conveniently positioned beneath the stationary platen. Furthermore, the mechanical connections of the presses are utilized in two ways for both the balancing valve and the stroke control apparatus.

It will also be apparent that variable impedance devices other than linear potentiometers may be utilized in variations of the first and the second illustrative presses, for example inductance devices.

I claim:

1. A cutting press comprising:

a. two platens one of which is supported by a plurality of columns for movement towards and away from the other to effect cutting and return strokes of the press, b. drive means connected to the columns for effecting such movement of the movable platen, and c. stroke control means for limiting the movement of the movable platen towards the other platen, said stroke control means comprising a limit switch actuation of which is effective to reverse the operation of the drive means, whereby the cutting stroke is terminated and a return stroke is initiated, d. said stroke control means comprising a control circuit having, e. signalling means by which a signal is generated the magnitude of which at any time during a cutting stroke is dependent upon the sum of the distance moved by two portions of the movable platen, which portions are symmetrically located with respect to the columns.

f. comparator means by which the magnitude of the signal is compared with a preselected value, g. switch actuating means by which, when the magnitude of said signal equals the preselected value, the limit switch is actuated, and h. said stroke control means comprises a further limit switch actuation of which is effective to terminate the return stroke of the press, together with further comparator means by which the magnitude of the signal generated by the signalling means is compared with a further preselected value, and further switch actuating means by which said further limit switch is actuated, when the magnitude of said signal equals the preselected value.

2. A cutting press according to claim 1 wherein said portions of the movable platen are constituted by portions to which the columns are attached, and wherein the signal generated by the signalling means is dependent upon the sum of the distance moved by the columns.

3. A cutting press according to claim 1 wherein the movable platen is rectangular and is supported by four columns arranged one at each corner thereof, and wherein said portions thereof are arranged diagonally opposed.

4. A cutting press according to claim 1 wherein the signalling mans is associated with balancing means comprising a balancing valve the spool of which is mechanically connected to said portions of the movable platen and, in the event that one of the portions moves more than the other, said balancing valve is shifted so as to cause said valve to operate to correct the imbalance.

5. A cutting press according to claim 1 wherein the signalling means comprises a variable impedance device which has two relatively movable parts, one connected with each of said portions of the movable platen, and the magnitude of the signal generated is dependent upon the relative position of said parts.

6. A cutting press according to claim 5 wherein the signal generated by the variable impedance device represents the sum of the distance moved by each of said portions of the movable platen.

* * * * *